United States Patent [19]

Wolfe

[11] Patent Number: 4,770,408

[45] Date of Patent: Sep. 13, 1988

[54] INFLATABLE TOY HAVING FLAT CENTER SECTION FLANKED BY BULBOUS SECTIONS

[75] Inventor: Henry S. Wolfe, Clearwater, Fla.

[73] Assignee: The Frenry Company, Inc., Clearwater, Fla.

[21] Appl. No.: 895,263

[22] Filed: Aug. 11, 1986

[51] Int. Cl.[4] ..... A63G 17/00

[52] U.S. Cl. ..... 272/52; 272/1 R; 446/226

[58] Field of Search ..... 272/1 R, 1 B, 52; 446/220, 221, 222, 223, 224, 225, 226, 153, 159, 267, 199, 29; 52/2 H; 5/449; 441/40

[56] References Cited

U.S. PATENT DOCUMENTS

| | | | |
|---|---|---|---|
| 254,265 | 2/1882 | Bone | 52/2 |
| 1,244,948 | 10/1917 | Brown | 446/225 |
| 1,951,193 | 3/1934 | Heighway | 446/224 |
| 2,408,789 | 10/1946 | Luisada | 52/2 |
| 2,672,628 | 3/1954 | Spanel | 52/2 |
| 2,959,820 | 11/1960 | Miller et al. | 272/52 |
| 3,098,317 | 7/1963 | Guzman | 272/1 R |
| 3,170,172 | 2/1965 | Kessman | 5/449 X |
| 3,230,663 | 1/1966 | Shabram | 446/224 |
| 3,779,201 | 12/1973 | Spahn | 272/1 B |
| 4,336,931 | 6/1982 | Van Staden | 272/1 B |
| 4,559,020 | 12/1985 | Wang | 446/225 |
| 4,594,743 | 6/1986 | Owen et al. | 5/449 X |

*Primary Examiner*—Robert A. Hafer
*Assistant Examiner*—Samuel Rimell
*Attorney, Agent, or Firm*—Herbert W. Larson

[57] ABSTRACT

An inflatable toy construction that allows an inflated yet flat or non-bulbous center section of a toy to be flanked by inflated, bulbous parts. The center section is formed by an I-beam construction that is modified to allow free flow of air between the flat center section and the bulbous parts of the toy which flank the center section. The modification includes baffle walls that do not extend across the entire center section so that air can move from a center section compartment defined by a pair of baffle walls to other compartments defined by other baffle walls that also do not extend completely across the center section. The modification further includes a substantially imperforate wall that surrounds and defines the center section, which wall is provided with a pair of apertures to provide fluid communication between the interior space of the center section and the spaces defined by the bulbous portions of the toy.

6 Claims, 3 Drawing Sheets

INFLATABLE TOY HAVING FLAT CENTER SECTION FLANKED BY BULBOUS SECTIONS

BACKGROUND OF THE INVENTION

1. Field of the Invention

This invention relates, generally, to inflatable toys, and more specifically to an inflatable toy formed of two different types of construction to provide a novel apparatus.

2. Description of the Prior Art

Inflatable objects in general are of course well known.

The art has developed two different constructions for inflatable objects: (1) the to-to-bottom weld and (2) the I-beam weld.

These constructions provide, respectively, bulbous items and flat or non-bulbous items.

In top-to-bottom welding, the peripheral edges of two flexible materials of the type suitable for use in inflatable construction are brought together and welded together by a process sometimes called heat welding. In this type of "welding", the edges of the respective pieces of materials are momentarily melted while held in pressed relation to one another so that a merger of materials can occur while the heated portions thereof are in a melted state, and a bond is formed when the heat source is removed.

Thus, the finished product ballons outwardly, assuming a bulbous shape, when air is introduced into the compartment surrounded by the welded edges.

In I-beam construction, the respective edges of the separate materials are not brought together as they are in the top-to-bottom technique.

Instead, an imperforate wall member, also preferably formed of the same materials used to construct inflatables, is positioned along the seam where the top and bottom materials would come together for bonding in the top-to-bottom method. A first, or top longitudinal edge of a wall is heat welded to one of the pieces of material along a seam and the bottom longitudinal edge of the wall is bonded to the other piece of material along a seam.

Thus, the seams where a direct bonding would have occurred in the top-to-bottom welding technique are now spaced apart by the height of the wall that interconnects them.

Even when the I-beam technique is employed, some bulbosity will still be present between contiguous baffle walls, but the amount of bulbosity is inversely proportional to the number of walls, i.e., the greater thenumber of baffle walls (i.e., the closer together the baffle walls are spaced apart relative to one another), the less bulbosity in the overall item constructed.

Thus, where it is desired to provide a relatively large inflatable object that is substantially flat, the I-beam construction is used. In a large object such as a raft, a plurality of walls are spaced at equidistant intervals throughout the area where flatness or sustantial absence of bulbosity is desired.

One problem with I-beam construction is that the wall members which join the opposite pieces of inflatable materials together define separate air compartments. An outside pressure broughtto bear on a compartment may cause a rupture of the object because air is not free to escape the comparment defined at its top and bottom by the outer surfaces of the inflatable object and at its sides by imperforate walls.

If an inflatable could be constructed so as to have a flat center section and bulbous outlying portions, then a number of novel items could be constructed which would take advantage of such feature.

SUMMARY OF THE INVENTION

The present invention provides playground rideable toys which are characterized by flat center sections and bulbous front and rear sections.

Accordingly, make-believe inflatable toys such as horses may be constructed having flat, narrow center sections suitable for straddling by a child and life-like, inflated head and rear portions of generally bulbous construction.

The center sections of the rideables are of I-Beam construction and the flanking portions thereof are of top-to-bottom welding construction. For purposes of this specification the central section is limited to those structures seen in FIG. 3.

A unique way of providing fluid communication between the flat center section and the outlying bulbous sections is proviced.

A wall surrounds and thus defines the peripheral boundaries of the center section and substantially separates it from the outlying bulbous sections. Inteior baffle walls ofimperforate construction which are spaced at preselected prefrably equidistant intervals within the center section divide it into a plurality of subcompartments so that a substantially flat center section is provided.

The baffle walls do not extend entirely across the center section so that air is free to flow from one subcompartment to another. Moreover, the wall that surrounds the center section is provided with preferably two small apertures to provide fluid communication between the flat center section and the outlying bulbous sections of the object.

Thus, pressure applied to the exterior of the object at any location will result in a redistribution of air within the object. Pressure applied to a bulbous portion of the object may cause air to fow through one of the apertures formed in the wall surrounding the center section, around the ends of the baffle walls therewithin, and back out into another bulbous portion of the object through another one of the apertures formed in the center section-defining wall.

Conversely, pressure applied to the center section may cause air within the object to flow around the ends of the baffle walls, out of the center section through one of the apertures formed in the peripheral wall, and back into the center section through another of the apertures.

Of course, fluid mechanics is a complex subject and it is an oversimplification to say that air would flow uniformly or monolithically through a first aperture in a first direction while flowing through a second aperture in a second direction, but it nevertheless should be clear that the apertures formed in the wall that surrounds the center section coooperate witht he specially constructed, incompletely extending baffle walls to provide fluid communication between all parts of the interior of objects constructed in accordance with the teachings and suggestions of the present invention.

It is an important object of this invention to advance the art of inflatable object construction by disclosing a construction technique whereby I-beam construction and top-to-bottom construction can be not only provided in a single object but moreover synergistically brought together in a single object to achieve inflatabel constructions heretofore unknown.

Another important object is to advance the art of I-beam construction by introducing baffle walls that do not extend from one end of an object to the other so that fluid communication between the different subcompartments of an I-beam constructed object can be provided.

Still another object is to provide a means whereby fluid communication can be maintained between two contiguous inflated objects when one of the objects is a bulbous object and the other is a flat object.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 6 illustrates how a rider can straddle the present invention with his legs in a near normal walking or running positions.

Similar reference numerals refer to similar parts throughout the several views of the drawings.

DETAILED DESCRIPTION OF THE PREFERRED EMBODIMENT

The present disclosure has its primary utility in the construction of inflatable items. It should therefore be understood from the outset that although the drawings appended hereto illustrate an inflatable toy in the form of a horse, such drawings are merely illustrative and the inventive concept has applications in the construction of numerous other inflatable items. For example, the inventive construction revealed herein could be employed to construct toy dinosaurs, giraffes, and the like; inflatable toys employing I-beam construction which could be constructed in accordance with the teachings and suggestions of this invention are virtually unlimited.

Many inflatable items are used in pool or other water environments. The present invention, however, is concerned primarily with non-water related toys. Specifically, the item shown herein for the purpose of illustrating the inventive concepts is a toy of the type that can be straddled by a child standing on dry land.

Figure 1:
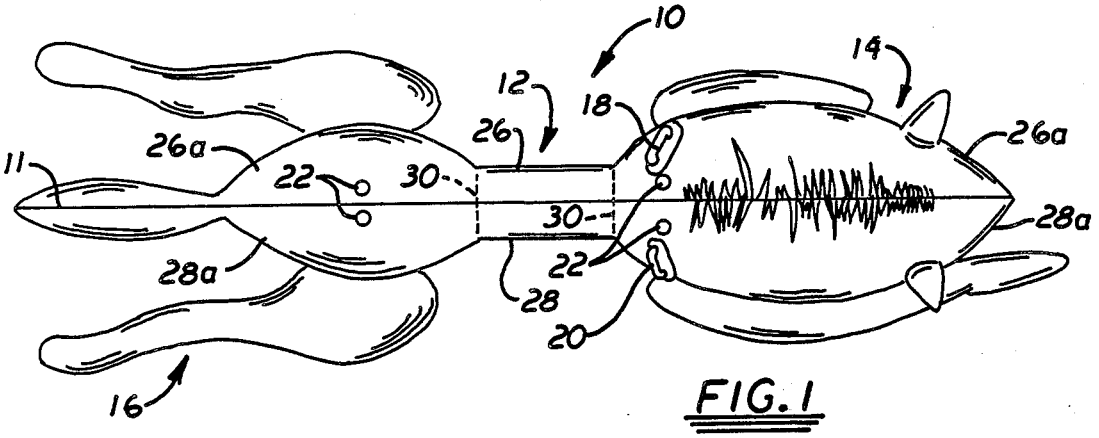
FIG. 1 is a top plan view of a playground rideable toy constructed in accordance with the teachings and suggestions of the present disclosure.

A top view of a horse 10 that is constructed in accordance with the teachings of this invention is provided in FIG. 1.

Horse 10 includes three primary sections, two of which are bulbous and one of which is not.

Horse 10 is formed by welding together its two half portions along welding line 11 that completely encircles the toy. The weld is of the top-to-bottom type, although in this particular instance it is more descriptive to refer to the weld as a side-to-side weld.

Center secton 12 is substantially flat or non-bulbous as shown whereas the forward and rearward sections, denoted 14 and 16 respectively, of horse 10 are bulbous as depicted.

The ears, legs, eyes, tail, mane and other well known horse parts are not numbered, nor is the child appearing in the last few drawings so that this disclosure can focus on inventive matters.

Figure 4:
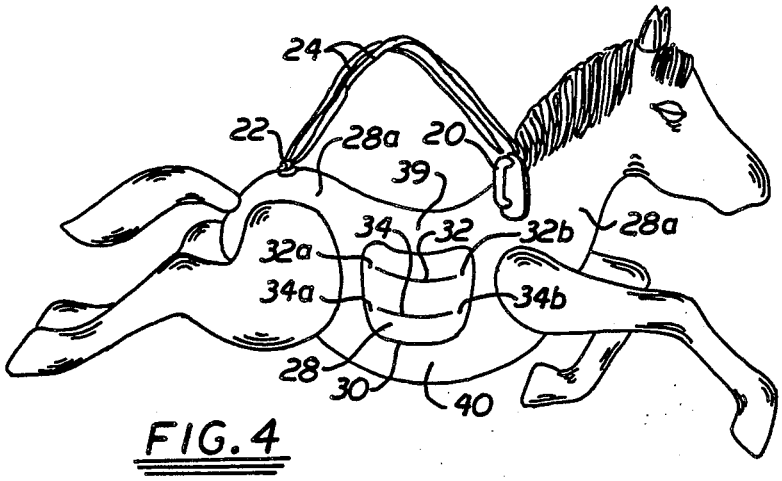
FIG. 4 is a side elevational view similar to that of FIG. 2, but further showing strap members attached thereto.
Figure 5:
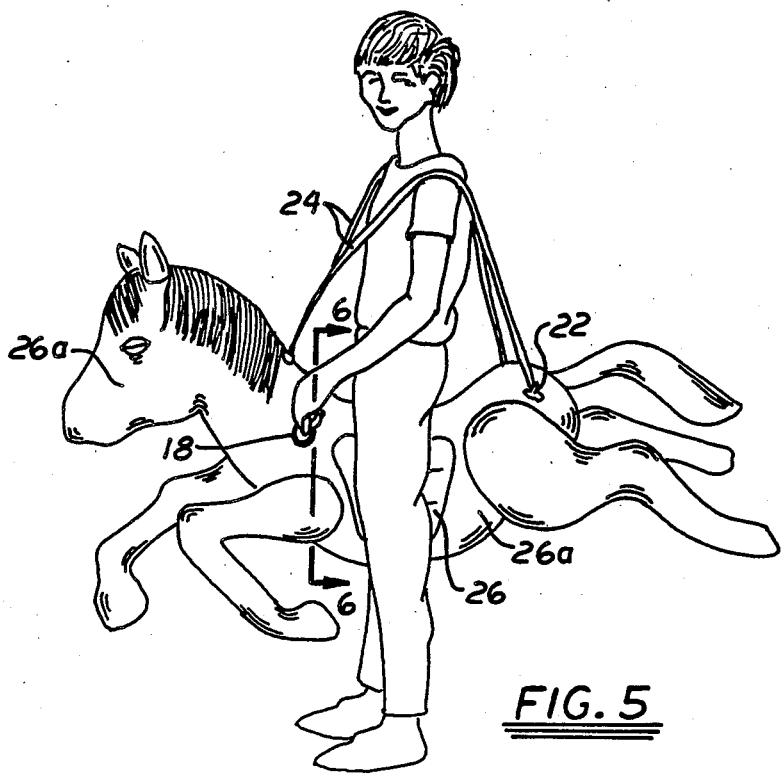
FIG. 5 is a side elevational view similar to that of FIG. 4, but further showing a child wearing the straps and straddling the object.

However, handle members 18, 20 are numbered to point them out as are strap connecting members, collectively designated 22, that serve to connect the strap members appearing in FIGS. 4 and 5, which strap members are denoted 24.

The child may hold the toy 10 by handles 18, 20, or either of them, disregarding straps 24, or he or she may employ straps 24 and disregard the handles or use any combination thereof.

The length of straps 24 is such that the toy 10 will be spaced apart from the ground when the child is wearing said straps and straddling the toy as is well depicted in FIG. 5. The straps are adjustable to accommodate children of different heights.

Figure 6:
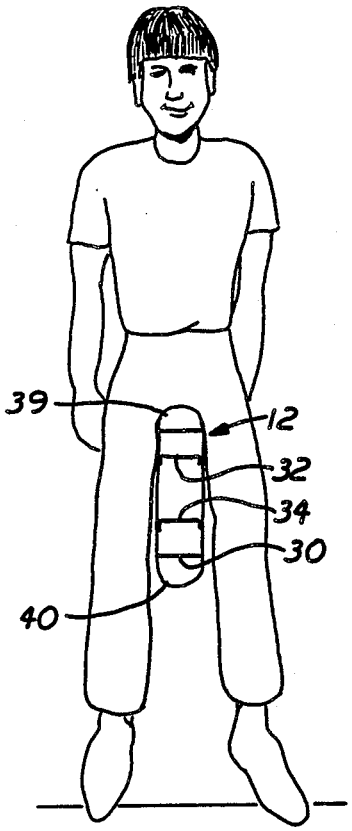
FIG. 6 is a sectional view taken generally along line 6—6 of FIG. 5. The phantom lines represent the non-bulbous center section of the invention.

As is clear from an inspection of FIGS. 1, 5, and 6, a child "riding" toy 10 can freely walk or run with it, whether using handles 18, 20, straps 24 or any combination thereof, due to the narrow width of center section 12.

Figure 7:
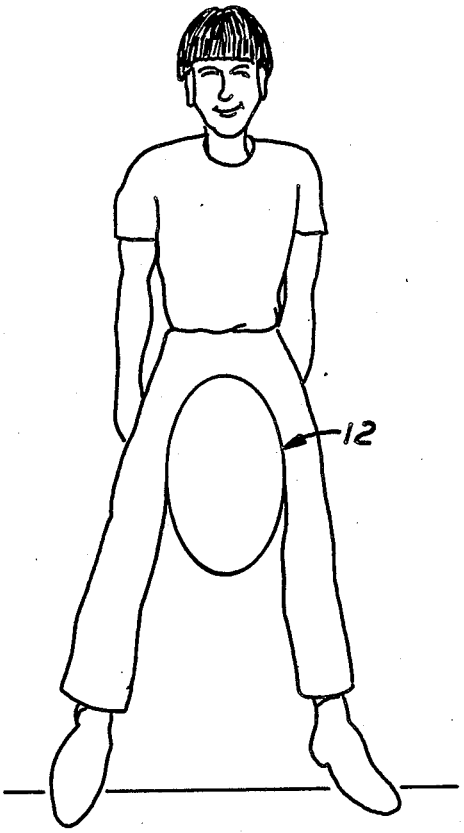
FIG. 7 depicts how a device of the prior art, lacking a flat center section, would require its rider to awkwardly straddle the same and thereby prevent him from running or walking normally.

If center section 12 were formed by the top-to-bottom welding method, which method is used to form forward and rearward sections 14, 16, then in such event center section 12 would also be bulbous and a child would be unable to walk or run freely while straddling toy 10. FIG. 7 depicts the abnormal stance a child would have to assume if the center section of a straddle type toy were bulbous; such a stance would substantailly prevent normal walking or running as is apparent from said FIG. 7.

Figure 8:
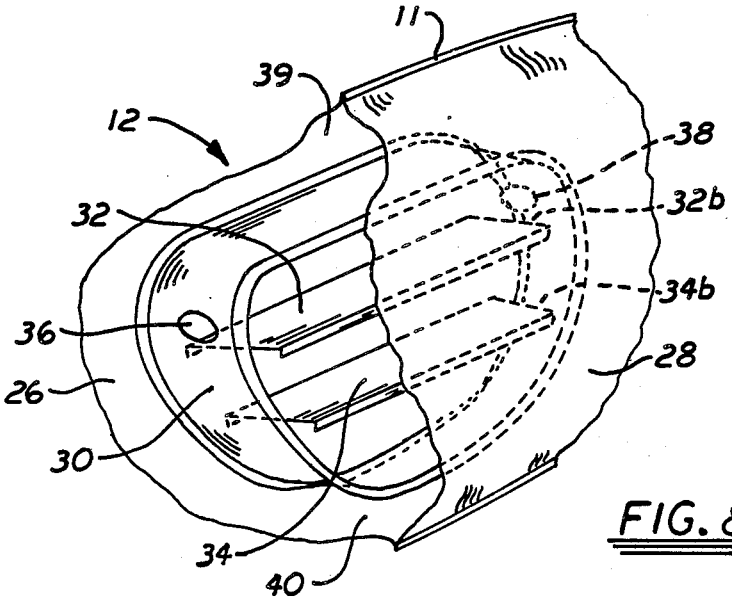
FIG. 8 is a partial sectional view of the center section of the invention.

FIG. 8 best illustrates how the flat center section 12 is constructed.

Figure 3:
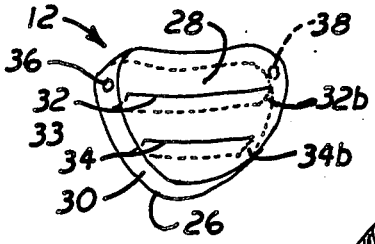
FIG. 3 is an isometric view of the center section of the object shown in FIGS. 1 and 2.

Center section 12 has imperforate side walls 26, 28. Walls 26 and 28 are the outermost walls as shown in FIGS. 1, 2, 3 and 8. Walls 26 and 28 are welded to the I-beam walls as shown in FIGS. 3 and 8.

Figure 2:
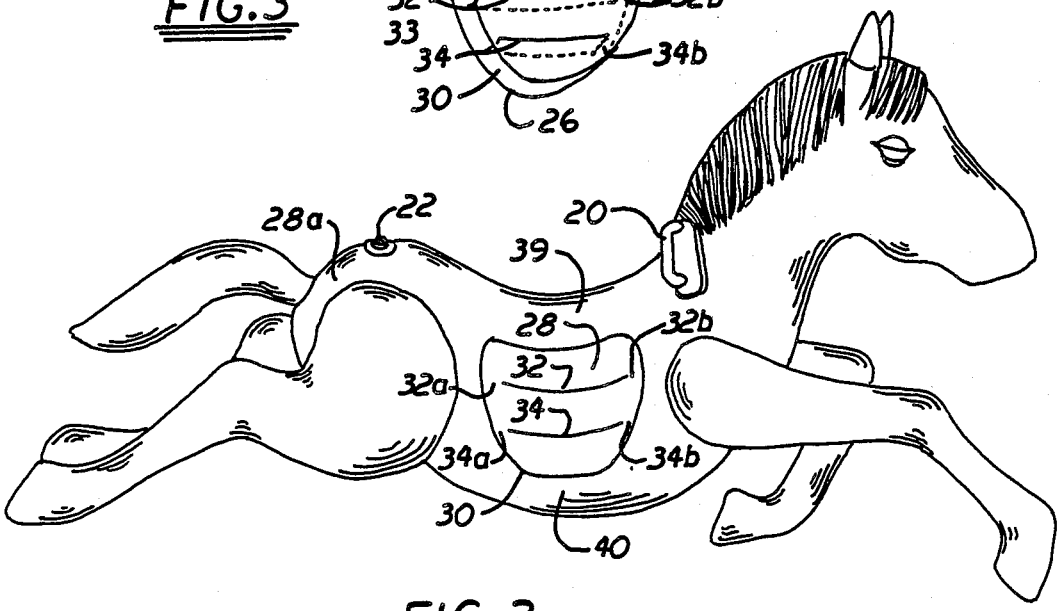
FIG. 2 is a side elevational view of the object shown in FIG. 1.

As is apparent from an examination of FIGS. 1 and 2, side walls 26, 28 are retained or forcibly held in a narrow vertical plane when toy 10 is in use, as a result of the I-beam construction thereof which construction is perhaps best understood in connection with FIG. 8.

A peripheral side wall or I-beam wall 30 surrounds and defines the contours of center section 12. The opposite edges of I-beam wall 30 also defines the welding line where the flat portions 26, 28 meet their respective bulbous portions **26*a*, 28*a***.

Baffle walls 32, 34 are positioned interiorly of center section 12 as shown in FIG. 8. One edge of each baffle wall is welded to surface 26 and its opposite edge is welded to surface 28 as is clearly depicted in FIG. 8.

Neither baffle walls 32 nor 34 extends across the entire extent of center section 12 as is suggested in FIG. 3 and as is perhaps best understood in connection with FIG. 2. For example, end 33 (see FIG. 3) of baffle wall 34 stops short of peripheral I-beam wall 30, with gap 34*a* (FIG. 2) resulting. Similarly, the opposte end of baffle wall 34 does not extend to I-beam wall 30, producing gap 34*b* (best shown in FIG. 2 but also visible in FIG. 3)

Thus, a gap exists between each ed of the baffle wall and the peripheral I-beam wall 30 so that air is free to flow from subcompartment to subcompartment within center section 12. As used herein, the term "subcompartment" refers to a spaced bounded at least on one side by a baffle wall and at its ends by pripheral I-beam wall 30. Gaps 32*a*, 32*b* at opposite ends of baffle wall 32 and gaps 34*a*, 34*b* at opposite ends of baffle wall 34 are marked in FIG. 2; gaps 32*b* and 34*b* are the only ones marked in FIG. 3 to keep said FIG. uncluttered.

A pair of aperture members 36, 38 are formed in peripheral I-beam wall 30 to allow fluid communication between the bulbous compartments 14, 16 and the nonbulbous center section 12. Thus, air is free to flow throughout the interior of item 10 without substantial restriciton, thereby reducing the probabilities that an unwanted rupture might occur and providing a sufficient safety valve action for center section 12 since it is small and partitioned.

The unique combination of flat and bulbous inflatable sections in an inflatable toy disclosed herein represents an advance in the art of inflatable construction. The narrow center section 12 could be made even more narrow than depicted in the drawings, if it were desired to further amplify the difference between the center and outlyng sections of the item built in accordance with the teachings hereof.

In FIG. 2, the areas denoted 39 (above "saddle" 28) and 40 (below "saddle" 28) are technically part of the bulbous construction of toy 10 because they are areas not surrounded by I-beam wall 30. However, due to their close proximity to I-beam wall 30 and their close proximity to side-to-side weld 11, i.e., as a result of being between two constricted areas, said areas 39 and 40 exhibit only ominal bulbosity; their bulbosity is essentially equal to the bulbosity existing in center section 12 between I-beams 32 and 34.

It will thus be seen that the objects set forth above, and those made apparent from the foregoing description, are efficiently attained and since certain changes may be made in the above construction without departing from the scope of the invention, itis intended that all matters contained in the foregoing description or shown in the accmpanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An inflatable toy, comprising: an inflated yet substantialy non-bulbous center section; an inflated, bulbous front section integrally formed with said center section;

an inflated, bulbous rear section integrally formed with said center section;

said bulbous front and rear sections being formed by heat welding together peripheral edges of corresponding halves of a flexible material;

an annular wall surrounding a portion of the center section, the annular wall at its edges welded to a pair of exterior side walls with fluid communicaiton means provided in the annular wall, the center section separating the front and rear sections so that air in said center section is free to flow to said bulbous sections and vice versa; and said center section being formed by I-beam construction, said center section having a narrow transverse dimension in relation to the respective transverse dimensions of said front and rear sections whereby said center section may be straddled comfortably.

2. The toy of claim 3, wherein said wall is a substantially annular, flexible I-beam having at least one aperture means formed therein to provide fluid communication between the center section of said toy and the front and rear sections.

3. The toy of claim 2, further comprising a plurality of substantially linear baffles positioned at spaced intervals within said center section, substantially parallel to one another, and wherein opposite ends of each of said linear baffles are spaced apart from said annular I-beam wall so that air within said center section can freely flow around the respective ends of said linear baffles.

4. An inflatable toy, comprising:

a first half portion of said toy having a predetermined dimension and configuration;

a second half portion of said toy having a complementary dimension and configuration so that when the two half portions are juxtaposed, a complete, bisymmetrical toy is provided;

a continuous weld line circumscribing said toy;

a continuous, substantially annular and substantially imperforate wall member positived intermediate said first and second half portions;

portions of said annular wall member being disposed substantially normal to said first and second half portions;

a first annular edge of said annular wall member welded to said first half portion;

a second annular edge of said annular wall member welded to said second half portion;

a plurality of substantially linear, spaced baffles disposed in surrounded relation to said annular wall member;

each of said linear baffles having a first longitudinal edge welded to said first half portion of said toy and having its opposite longitudinal edge welded to said second half portion of said toy;

whereby a section of the toy that is surrounded by said annular wall member is constrained by said annular wall and said linear baffles to maintain a substantially nonbulbous configuration when the toy is inflated and whereby the portions of said toy not surrounded by said annular wall member are not constrained except by said circumscribing weld so that they assume a bulbous configuration when the toy is inflated.

5. The toy of claim 4, wherein at least one aperture means is formed in said annular wall member.

6. The toy of claim 5, wherein said liner baffles have opposite ends that are spaced apart from said annular wall member to thereby define gaps through which air may flow.

* * * * *